United States Patent [19]

Skaja

[11] Patent Number: 4,837,960

[45] Date of Patent: Jun. 13, 1989

[54] ARTICLE WITH IDENTIFYING DEVICE

[75] Inventor: Joseph J. Skaja, San Antonio, Tex.

[73] Assignee: Kaepa, Inc., San Antonio, Tex.

[21] Appl. No.: 233,839

[22] Filed: Aug. 15, 1988

Related U.S. Application Data

[63] Continuation of Ser. No. 734,738, May 17, 1985, abandoned.

[51] Int. Cl.[4] ..... A44C 3/00

[52] U.S. Cl. ..... 40/636; 40/642; 40/299; 36/136

[58] Field of Search ..... 40/636, 642, 299, 629, 40/628, 301; 63/2, 29 R; 36/1, 45, 100, 132, 136

[56] References Cited

U.S. PATENT DOCUMENTS

| | | | |
|---|---|---|---|
| 662,449 | 11/1900 | Levy | 63/29 R |
| 902,573 | 11/1908 | Fleck | 40/2 E |
| 1,520,224 | 12/1924 | Bush | 40/2 E |
| 1,583,274 | 5/1926 | Bostock | 136/136 |
| 1,689,124 | 10/1928 | Fitzgerald | 63/29 R |
| 1,825,692 | 10/1931 | Hayden | 40/2 E |
| 1,952,409 | 3/1934 | Berg | 36/136 |
| 1,977,995 | 10/1934 | Morali | 36/136 |
| 2,141,363 | 12/1938 | Rigollet | 63/29 |
| 2,413,541 | 12/1946 | Brady | 63/3 |
| 2,489,368 | 11/1949 | Faybert | 36/1 |
| 2,521,558 | 9/1950 | Alvarez | 63/29 R |
| 2,674,107 | 4/1954 | Bodnar | 63/29 R |
| 3,039,279 | 6/1962 | Van Bussel | 63/29 R |
| 3,564,736 | 2/1971 | Cunningham | 36/1 |
| 3,811,211 | 5/1974 | Morgan | 40/628 |
| 3,831,398 | 8/1974 | Davis, Sr. | 63/29 R |
| 4,052,773 | 10/1977 | Nesbitt | 63/29 R |
| 4,130,950 | 12/1978 | Bazzle et al. | 36/132 |
| 4,344,240 | 8/1982 | Schiller | 40/301 |

FOREIGN PATENT DOCUMENTS

| | | | |
|---|---|---|---|
| 113159 | 1/1926 | Switzerland | 40/2 E |
| 1347424 | 2/1974 | United Kingdom | 36/136 |

*Primary Examiner*—John J. Wilson
*Assistant Examiner*—J. Hakomaki
*Attorney, Agent, or Firm*—Cohn, Powell & Hind

[57] ABSTRACT

This identifying device is attached to a portion of an article such as a shoe and includes a retainer having a flanged base and raised peripheral walls defining at least one socket. Identifying elements having the same configuration as the sockets are removably snap-fitted into the sockets. The shoe portion includes attached upper and lower plies of material, the upper ply having openings receiving the peripheral walls and overlying the flanged base to hold the retainer in place.

6 Claims, 1 Drawing Sheet

ARTICLE WITH IDENTIFYING DEVICE

This application is a continuation of application Ser. No. 734,738, filed May 17, 1985.

BACKGROUND OF THE INVENTION

This invention relates generally to an article identifying device and particularly, but not exclusively, to the provision of an identifying device on footwear, luggage and other personal articles.

The provision of identifying indicia on clothing, including footwear, and on luggage and other similar articles serves at least two purposes. One purpose is to identify the manufacturer of the article and, to this end, such articles are frequently provided with representative insignia of the manufacturer such as a distinctive logo or trademark which provides the purchaser with a means of identifying the source of goods. Another purpose is to identify the owner of the article, for example by use of a distinctive color. This latter purpose is particularly applicable to athlete's apparel and other sporting equipment in team sports and it is common for the athletes and cheerleaders to wear clothing bearing the team colors as well as the team name.

While it is relatively easy to provide most articles of clothing, such as shirts and shorts, with the desired means of identification it is more difficult to provide the same identification on footwear and other articles. It is possible to attach color and shape patches to such articles by Velcro hook and loop fasteners, for example, but there are disadvantageous in that the patches tend to curl and are susceptible to being inadvertently pulled from the article.

The present invention solves this problem in a manner not available in the known prior art.

SUMMARY OF THE INVENTION

This invention provides a means of attaching identifying indicia to articles such as footwear, luggage and other personal articles so that it cannot readily be inadvertently removed.

This article having an identifying device attached thereto, includes an article portion; a retainer including a base and a peripherally extending raised wall attached to the base and defining a socket; means for attaching the retainer to the article portion; an identifying element having substantially the same shape as the socket, and means between the retainer and the element holding the element in captive relation in the socket.

It is an aspect of this invention to provide the article portion with first and second plies of material the second ply including an opening, and to provide the base with an outstanding flange at least in part sandwiched between the plies of material the raised wall, of the retainer extending outwardly from the opening.

It is another aspect of this invention to provide the wall and identifying element with a cooperating rib and groove to provide the means of holding the element within the socket.

It is yet another aspect of this invention to provide that one of the wall and identifying portions is formed from a relatively resilient material whereby the identifying element is snap-fittingly receivable into the socket.

Still another aspect of this invention is to provide the retainer with a second peripherally extending wall defining a second socket and to provide a second identifying element. It is yet another aspect of this invention to provide a pair of sockets and elements of generally triangular configuration, still another aspect to provide that the elements are of a different color; yet another aspect to provide that the elements include opposed faces of different color and another aspect to provide that the peripheral walls are substantially transparent.

DESCRIPTION OF THE PREFERRED EMBODIMENT

Figure 1:
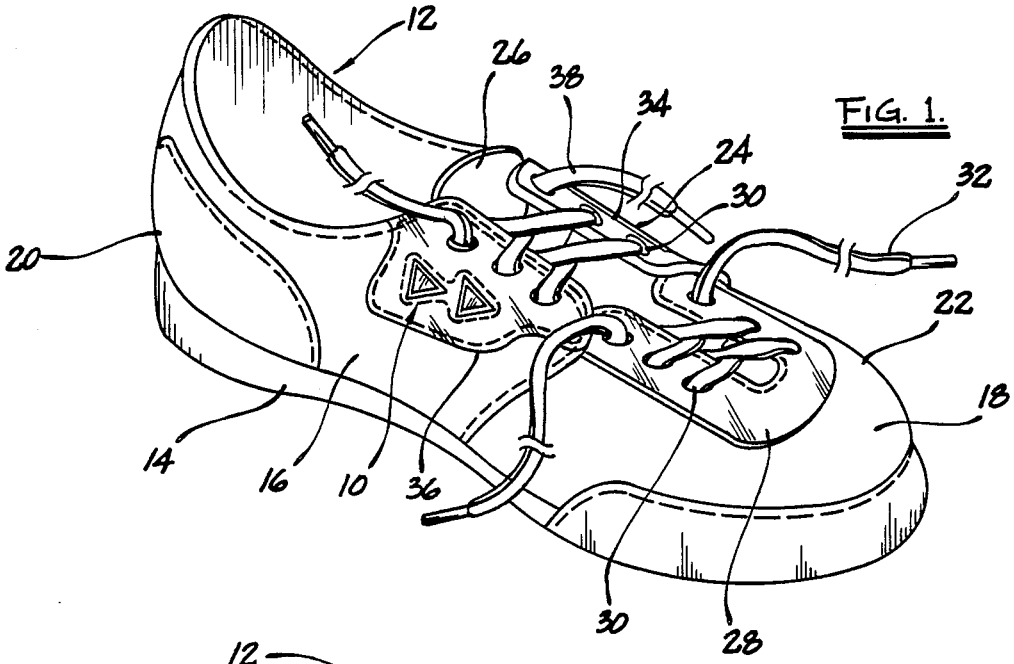
FIG. 1 is a perspective view of an athletic shoe incorporating the identifying device.

Referring now by reference numerals to the drawing and first to FIG. 1 it will be understood that an identifying device, generally indicated by numeral 10, is intended for attachment to an article which is shown, by way of example, as an article of footwear such as an athletic shoe 12.

In the embodiment shown the athletic shoe 12 is generally of the double vamp, double lace type of athletic shoe disclosed in U.S. Pat. No. 3,546,729. However, it will be understood that this particular shoe is shown merely by way of illustration and that the identifying device 10 can also be used with other shoes such as the more common single vamp, single athletic lace shoe.

The shoe 12 is conventional in that it includes a sole 14 and an upper portion 16 attached to the sole as if by stitching. The upper 16 includes a toe 18, a heel 20, and lower and upper vamp portions 22 and 24, respectively, overlying a tongue 26. The lower vamp portion 24 includes a U-shaped reinforcing portion 28 having eyelets 30 receiving a lower lace 32 and the upper vamp portion 24 includes inner and outer reinforcing portions 34 and 36 respectively, having eyelets 30 receiving an upper lace 38. The inner reinforcing portion 34 is in the form of a strip of conventional width. However, the outer reinforcing portion 36 is substantially wider to accommodate the identifying device 10 between the two plies of material provided by the vamp reinforcing portion 36 and the underlying material 24' of the vamp portion 24.

Figure 2:
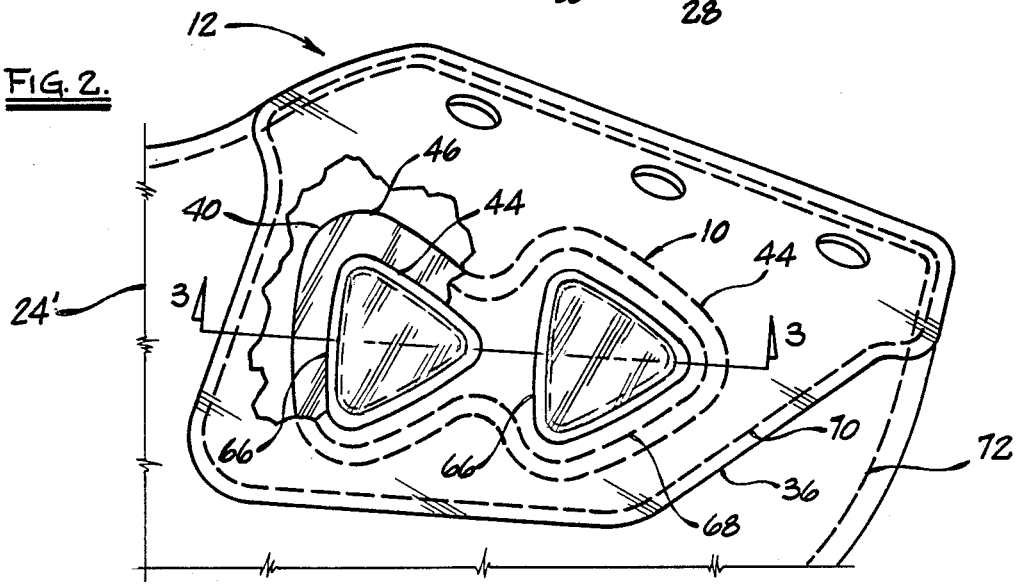
FIG. 2 is an enlarged plan view of the identifying element.
Figure 4:
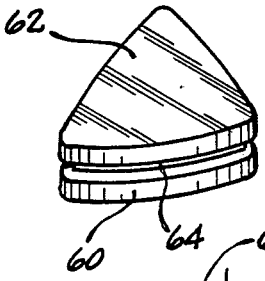
FIG. 4 is a perspective view of a removable identifying element.
Figure 3:
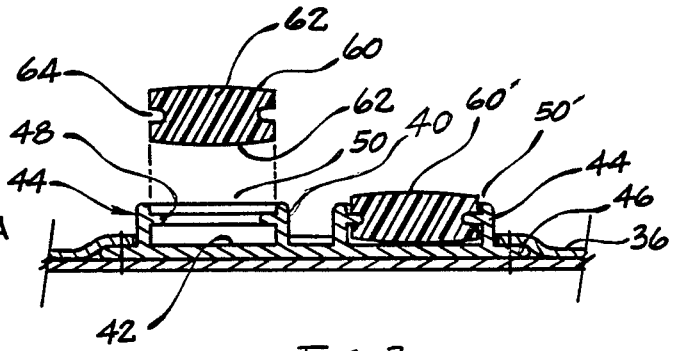
FIG. 3 is a sectional view taken on line 3—3 of FIG. 2.

The identifying device 10 is best shown by reference to FIGS. 2, 3 and 4 and, in the preferred embodiment, includes a retainer 40 having a base 42 and a pair of peripherally extending raised walls 44. The base 42 extends outwardly of the raised walls 44 to provide a continuous flange 46 and the raised walls 44 each include a peripherally extending rib 48. The raised walls 44 cooperate with the bottom wall 42 to define a pair of sockets 50 and 50' which, in the embodiment shown, are of identical, generally triangular configuration. However, it will readily be understood that the configurations of the two sockets 50 and 50' are not limited to being of the same form.

The identifying device 10 also includes a pair of identifying elements 60 and 60' which are of substantially the same shape and size as the associated sockets 50 and 50' so that they are readily receivable by said sockets. Each identifying element 60 and 60' includes upper and lower convex faces 62 and a peripheral groove 64 which is of a size to receive the wall rib 48. The identifying elements 60 and 60' are intended to be a snap-fit into the associated sockets 50 and 50' respectively. Accordingly, either the sockets or the elements or both, as in the embodiment shown, are formed from a resilient material. Such material can be rubber or thermoplastic, the latter having the advantage that it can readily be colored. The elements 50 and 50' can if desired be either the same color or two different colors. In addition, the upper face can be colored differently from the lower face. Because of their shape and resilience, said elements 60 and 60' can readily be temporarily deformed for insertion into the sockets 50 and 50', the cooperating ribs and grooves 48 and 64 providing a means for holding the elements 60 and 60' in captive relation within associated sockets 50 and 50' of the retainer 40.

Figure 6:
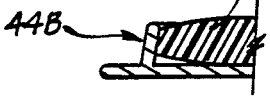
FIG. 6 is a fragmentary sectional view of another modified identifying device.
Figure 5:
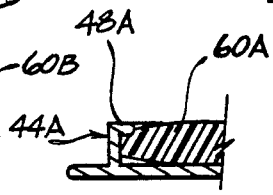
FIG. 5 is a fragmentary sectional view of a modified identifying device.

FIGS. 5 and 6 show modified holding means. In FIG. 5, an upper rib 48A is provided for the wall 44A which is engageable with the upper face 62 of the identifying element 60A. In FIG. 6 the wall 44B and the side of the element 60B are cooperatively inclined to be engageable with each other. In other respects the retainer and snap-fit identifying elements shown in FIGS. 5 and 6 are identical.

As shown in FIGS. 2 and 3 the identifying device 10 is attached to the upper portion 16 of the shoe by cooperation between the continuous flange 46 and the underlying and overlying plies of material provided by the underlying vamp material 24' and the reinforcing portion 36. To this end, the reinforcing portion 36 includes openings 66 which are of substantially the same size and configuration of the outside dimension of the raised walls 44. Because of this arrangement the margins of the reinforcing portion openings 66 overlaps the flange 46 and the attachment is completed by a peripheral line of stitching 68 around the flange 46. It will be understood that the material of the retainer is of thermoplastic material, or the like, which is sufficiently strong to hold the identifying element in place but can be pierced for stitching. In order to faciliate attachment of the retainer 40, the stitching 70 attaching the reinforcing portion 36 to the underlying vamp material 24' is accomplished after the retainer 40 is stitched to said strip 36.

Preferrably, the shoe 12 is delivered to the user with a choice of several elements 60 and 60' of different colors. The elements 60 and 60', because of their snap-fit relationship with associated sockets 50 and 50', are readily removable. They are just as readily installed with elements of a different color to suit the user but are nevertheless securely retained in position when pressed into place. Because of this it is a simple matter for the identifying device to be made in a particular shape, for example, of a manufacturer's logo, and to be made of distinguishing colors, for example, to suit particular athletic team colors. Further, to provide additional versatility each face of each element can be colored differently. In the preferred embodiment the raised walls 44 defining the sockets 50 and 50' are of a generally transparent material to disclose more fully the color of the elements 60 and 60'.

It will be understood that while the identifying device has been shown as used on an article of footwear it is not limited to this use and can be used, for example, for personalizing other articles such as luggage, handbags, identification tags and similar articles.

In view of the above it will be seen that various aspects and features of the invention are achieved and other advantageous results attained. While preferred embodiments of the invention have been shown and described, it will be obvious to those skilled in the art that changes and modifications may be made therein without departing from the invention in its broader aspects.

I claim as my invention:

1. In an article of footwear having an identifying device attached thereto:

(a) an article portion including a first ply of material and a second ply of material attached to the first ply of material in overlying relation, said second ply including a socket-accessible opening, (b) a retainer including a base and a peripherally extending wall defining a socket of substantially the same size as the socket-accessible opening, the base being, at least in part, sandwiched between said first and second plies of material, said base extending outwardly to provide a lower flange, said flange being fixedly attached to at least one of said plies of material for attaching the base to the article portion, (c) an identifying element interfitting the socket and having substantially the same size thereof, and (d) means between the retainer and the element for removably holding the element, in captive snap-fitting relation in the socket, at least one of said retainer and identifying element being of resilient material.

2. An article of footwear having an identifying device attached thereto as defined in claim 1, in which:

(e) the means holding the element in captive relation within the socket includes a groove portion and an interfitting rib portion, one of said portions being integrally formed with the wall and the other of said portions being integrally formed with the element, and (f) the identifying element received by the socket includes an upper portion disposed above the interfitting groove and rib portions having substantially the same size and shape as the socket.

3. In an article of footwear having an identifying device attached thereto:

(a) an article portion including an underlying ply of fabric material and an overlying ply of fabric material, said overlying ply having socket-accessible opening means, (b) a retainer including a base and a pair of spaced peripherally extending walls, said walls defining a pair of sockets having substantially the same size as the socket-accessible openings, the base including an outwardly extending flange disposed about both of said sockets, said flange being sandwiched between said plies of material and being fixedly attached to at least one of said plies of material, and (c) a pair of identifying elements each interfitting an associated socket and having substantially the same size thereof, and (d) means between the retainer and the elements for removably holding the elements in captive, snap-fitting relation in the sockets at least said elements being of resilient material.

4. An article having an identifying device attached thereto as defined in claim 3, in which:

(e) the elements and sockets are of generally triangular configuration.

5. An article of footwear having an identifying device attached thereto as defined in claim 3, in which:

(e) elements are interchangeable with each other and are of different color.

6. In an article of footwear having an indentifying device attached thereto:

(a) a footwear upper portion including an underlying ply of material and a vamp reinforcing portion providing an overlying ply of material, said overlying ply having socket-accessible opening means, (b) a retainer of resilient plastic material including a base and a pair of spaced, peripherally extending walls extending through and being substantially the same combined size as the opening means, said walls defining a pair of sockets, the base including a flexible outwardly extending common flange disposed about said sockets and being sandwiched between said plies of material and being stitched to at least said overlying ply of material, and (c) a pair of resilient identifying elements each interfitting an associate socket and each having an upper identifying face, and (d) tongue and groove means between the retainer walls and the associated elements removably holding the elements in captive, snap-fitting relation in the sockets, the tongue being provided on the socket walls and the groove being provided on the elements, and (e) the elements and sockets being substantially triangular and of the same size and the elements being interchangeable in the sockets and of different color.

* * * * *